United States Patent [19]

Cadoret

[11] Patent Number: 4,554,684

[45] Date of Patent: Nov. 26, 1985

[54] MEN'S COMBINATION BRIEFS AND HOSE

[76] Inventor: Genevieve L. Cadoret, c/o Papin, 306 W. 91st St., New York, N.Y. 10024

[21] Appl. No.: 542,420

[22] Filed: Oct. 17, 1983

[51] Int. Cl.[4] ..... A41D 1/06; A41B 9/00

[52] U.S. Cl. ..... 2/227; 2/400

[58] Field of Search ..... 2/67, 400, 240, 409, 2/227, DIG. 6, 239

[56] References Cited

U.S. PATENT DOCUMENTS

| | | | |
|---|---|---|---|
| 2,166,514 | 7/1939 | Zapis | 2/67 |
| 3,362,029 | 1/1968 | Comerma | 2/227 X |
| 4,145,763 | 3/1979 | Abrams et al. | 2/DIG. 6 |
| 4,258,440 | 3/1981 | McGowan | 2/227 |

FOREIGN PATENT DOCUMENTS

| | | | |
|---|---|---|---|
| 2336681 | 1/1975 | Fed. Rep. of Germany | 2/227 |

*Primary Examiner*—Doris L. Troutman

*Attorney, Agent, or Firm*—Richard L. Miller

[57] ABSTRACT

A garment having a right side portion and a left side portion, with a mating mechanism applied to the left side portion and the right side portion such that each portion may mate with the other to form an entire garment but when said right side portion and said left side portion are separated they are identically indistinguishable from each other.

5 Claims, 5 Drawing Figures

MEN'S COMBINATION BRIEFS AND HOSE

BACKGROUND OF THE INVENTION

The instant invention relates generally to undergarments and more specifically it relates to a men's combination briefs and hose.

Numerous undergarments have been provided in prior art that are adapted to be worn by men. For example, U.S. Pat. Nos. 2,190,425; 4,035,844 and 4,089,064 all are illustrative of such prior art. While these units may be suitable for the particular purpose to which they address, they would not be as suitable for the purposes of the present invention as heretofore described.

SUMMARY OF THE INVENTION

A principle object of the present invention is to provide a men's combination briefs and hose undergarment that has a right sided portion and a left sided portion being releasably engaging from each other, such that both portion when separated are identically indistinguishable from each other.

Another object is to provide a men's combination briefs and hose undergarment that is formed of a light weight material that stretches to fill all contours of a man's body when being pulled on.

An additional object is to provide a men's combination briefs and hose undergarment that uses hook and loop fabric fastener material to releasably engage the right sided portion to the left sided portion.

A still additional object is to provide a men's combination briefs and hose undergarment that has the hook and loop fabric fastener material designed therein so that the right sided portion and the left sided portion are interchangeable with each other.

A further object is to provide a men's combination briefs and hose undergarment that is simple and easy to use.

A still further object is to provide a men's combination briefs and hose undergarment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENTS

Figure 1:
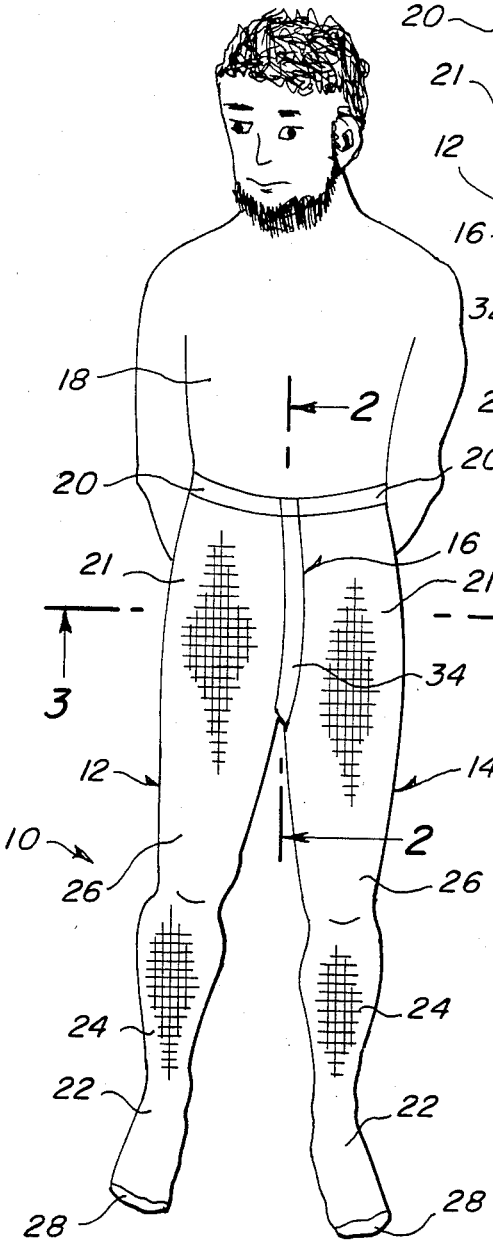
FIG. 1 is a front view of the invention being worn by a man.

Turning now descriptively to the drawings, in which similar reference characters denote similar elements throughout the several views, FIGS. 1 through 5 illustrates a men's combination briefs and hose undergarment 10. The undergarment 10 consists of a right sided portion 12, a left sided portion 14 and a fastener 16 for releasably engaging the right sided portion 12 to the left sided portion 14.

The right sided portion 12 and the left sided portion 14 are formed of a light weight material, such as nylon or any other synthetic fabric, that stretches to fill all contours of a man's body 18, as they are pulled thereon.

The right sided portion 12 and the left sides portion 14 each contain an attached encircling belt 20 of elastic material forming a waistband that is adapted to retain the brief portions 21 of the undergarment 10 in position when worn.

The right sided portion 12 and the left sided portion each contain a stocking-like enclosure 22 at the bottom 24 of the hose adapted to maintain the bottom 24 of the hose 26 at an area of a foot of the man 18. The stocking-like enclosure 22 also has a reinforced area 28 for toes.

Figure 5:
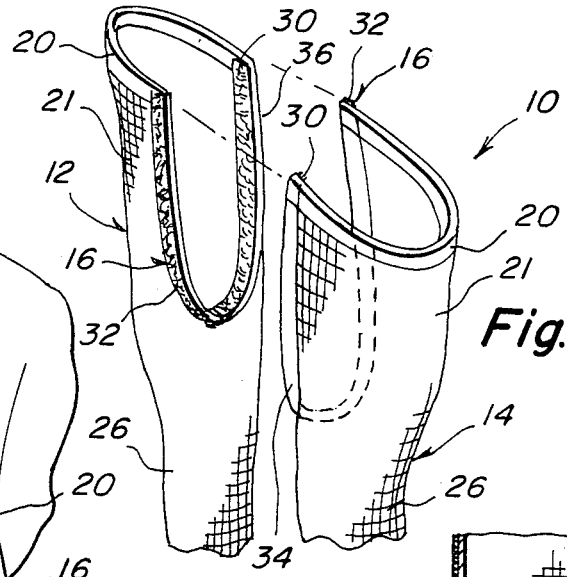
FIG. 5 is an exploded perspective view showing how the two halves of the invention mate together.
Figure 2:
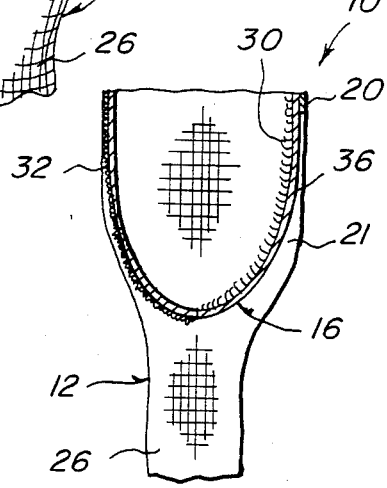
FIG. 2 is a partial vertical cross sectional view taken along line 2—2 in FIG. 1.
Figure 3:
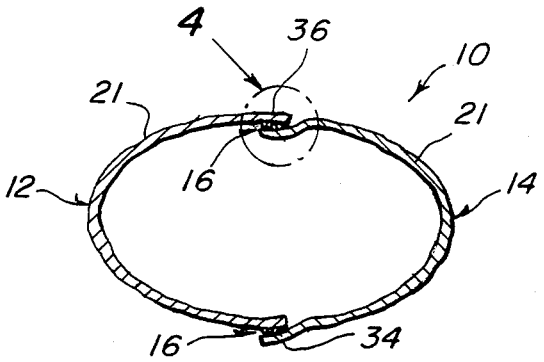
FIG. 3 is a horizontal cross sectional view taken along line 3—3 in FIG. 2.
Figure 4:
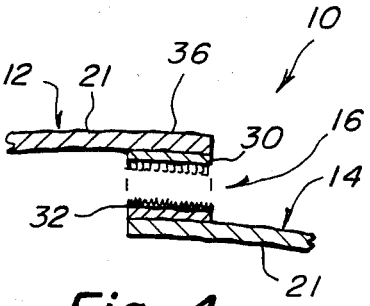
FIG. 4 is an enlarged cross sectional view as indicated by the circle 4 is FIG. 3.

The fastener for releasably engaging the right sided portion 12 and the left sided portion 14 contain hook 30 and loop 32 fabric fastener material that are attached to crotch 34 and seat 36 segment areas. As best shown in FIGS. 2 and 5 the hook fabric fastener material is applied to one half of the crotch 34 and seat 36 segment areas while the loop fabric fastener material 32 is applied reversely to other half of the crotch 34 and seat 36 segment areas. The right sided portion 12 and the left sided portion 14 are interchangeable thus reversing the crotch 34 and seat 36 segment areas thereto. If either the left sided portion 12 or the right sided portion 14 has to be replaced because of damage or wear another identical sided portion (not shown) can be used as a replacement.

It is to be further observed that if the particular garment does not have feet that both half are exactly identical a feature which is highly desirable, because if the garment is damage the half which need be replaced can be used as either a left or a right portion.

Although the drawing illustrate the that loop pile fastener is used for securement of the two identical halves together, any other suitable fastener mechanism might be substituted in place there of: not to mention just a few, such as snaps, hooks & eyes, button & button holes, etc.

It is also to be noted that although this specification continually implies that the garment is intended for men it might just as well before women, children, etc.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A pants garment comprising two identical portions each one of which can be used as a right side portion and a left side portion wherein identical mating fastener means are applied to both said portions such that each portion may mate with the other to form an entire garment but when said right side portion and said left side portion are separated they are identically indistinguishable from each other, wherein said mating fastener means comprises strips of loop fastener material which engage corresponding strips of hook fastener material, said mating fastener means being coupled on each portion along an arcuate path extending along the crotch and seat areas beginning and terminating at the waist, a strip of loop fastener material extending halfway along said arcuate path and a strip of hook fastener material extending the other halfway along said arcuate path.

2. A pants garment as recited in claim 1 which further comprises:

(a) a right sided portion formed of a material that stretches to fill all contours of a right side of a user's body as the right sided portion is pulled thereon;

(b) a left sided portion formed of a material that stretches to fill all contours of a left side of a user's body as the left sided portion is pulled thereon; and (c) means for releasably engaging the right sided portion to the left sided portion.

3. A pants garment as recited in claim 2 wherein the right sided portion and the left sided portion each comprises means at their waist thereof adapted to retain the garment in position when worn.

4. A pants garment as recited in claim 3 wherein the right side portion and the left sided portion waist means comprises an attached encircling belt of elastic material forming a waist band thereon.

5. A pants garment as recited in claim 1, wherein the coupling surfaces of both said strips face the same direction, wherein one of said strips faces exteriorly from an outer surface of said portion and the other strip faces interiorly from an inner surface of said portion.

* * * * *